US007178846B2

(12) United States Patent
Niskanen

(10) Patent No.: US 7,178,846 B2
(45) Date of Patent: Feb. 20, 2007

(54) DEVICE AND METHOD FOR HANDLING CONTAINERS

(75) Inventor: Mika Niskanen, Helsinki (FI)

(73) Assignee: Finnlines Oyj, Helsinki (FI)

( * ) Notice: Subject to any disclaimer, the term of this patent is extended or adjusted under 35 U.S.C. 154(b) by 0 days.

(21) Appl. No.: 10/517,894

(22) PCT Filed: Jun. 12, 2003

(86) PCT No.: PCT/FI03/00469

§ 371 (c)(1),
(2), (4) Date: Jun. 30, 2005

(87) PCT Pub. No.: WO2004/002870

PCT Pub. Date: Jan. 8, 2004

(65) Prior Publication Data

US 2005/0242601 A1 Nov. 3, 2005

(30) Foreign Application Priority Data

Jun. 26, 2002 (FI) ..... 20021249

(51) Int. Cl.
*B66C 1/10* (2006.01)

(52) U.S. Cl. ..... 294/81.54; 294/81.2

(58) Field of Classification Search ..... 294/81.1, 294/81.2, 81.21, 81.53, 81.54, 81.62
See application file for complete search history.

(56) References Cited

U.S. PATENT DOCUMENTS

| | | | | |
|---|---|---|---|---|
| 3,606,053 A * | 9/1971 | Whiteman | 414/739 |
| 3,863,970 A | 2/1975 | Gottlieb et al. | 294/67 DA |
| 4,341,495 A * | 7/1982 | Del'Acqua | 410/78 |
| 5,280,980 A | 1/1994 | Coatta | 294/81.1 |
| 5,511,927 A | 4/1996 | Lanigan, Sr. et al. | 414/460 |
| 5,718,550 A | 2/1998 | Lanigan, Sr. et al. | 414/140.3 |
| 6,138,846 A | 10/2000 | Baumann | 212/326 |
| 6,145,903 A | 11/2000 | Stinis | 294/81.21 |

FOREIGN PATENT DOCUMENTS

| | | |
|---|---|---|
| DE | 3621648 | 1/1988 |
| EP | 0183320 | 6/1986 |
| GB | 2147266 | 5/1985 |
| WO | 9806656 | 2/1998 |

* cited by examiner

*Primary Examiner*—Dean J. Kramer
(74) *Attorney, Agent, or Firm*—Wolf Block Schorr & Solis-Cohen LLP

(57) ABSTRACT

A device in the handling of containers, by means of which device at least two containers are handled. The device comprises a frame, to whose guides end pieces have been movably attached, which end pieces comprise attachment members for attaching the device to the corner fittings of the lowermost container(s) of the containers placed on top of one another. The invention also relates to a method in the handling of containers, in which method at least two containers are handled by means of a container transfer device, which container transfer device comprises a gripping member or equivalent. In the method, at least two containers placed on top of one another are handled. In the method for handling containers, a device is attached to the gripping member of the container transfer device, which device is placed on the containers, placed on top of one another, and attached to corner fittings of the containers such that attachment members situated on end pieces fixed to guides of a frame of the device are arranged to be attached to the apertures in the corner fittings of the container.

10 Claims, 7 Drawing Sheets

DEVICE AND METHOD FOR HANDLING CONTAINERS

FIELD OF THE INVENTION

The present invention relates to a device in the handling of containers. The invention also relates to a method in the handling of containers.

BACKGROUND OF THE INVENTION

As known in the art there exist standards relating to the size and structures of containers. ISO standard 668: 1988/1:1993 specifies the location of the corner fitting apertures of the container with respect to one another, and the dimensions of the containers. ISO standard 1161 specifies the shape of the corner fitting apertures of the container, and the permissible mode of handling the container is specified in the standard SFS-ISO 3874.

As known in the art, empty containers generally weigh below 5000 kg. The standardized container lengths are 10, 20, 30 and 40 feet. The 40 foot long containers have a height of either 8½ feet or 9½ feet and the 20 foot long containers have a height of 8½ feet. The prior-art container moving devices, for example, straddle carriers, usually comprise length adjustment, so that the handling length can generally be adjusted to be 20, 30 or 40 feet. Applications are also known in which the handling length can be adjusted to be 35 feet. Containers are handled as empty and as full.

With respect to the prior art, reference may be made, for example, to U.S. Pat. Nos. 3,863,970, 5,280,980 and 6,145,903. In these prior-art arrangements, which mainly relate to the handling of full 20 foot containers, two containers are placed longitudinally one after the other in the handling equipment. Such devices are generally massive because full containers weigh as much as 40 tonnes. In addition, handling is problematic because the structure with its containers becomes rather long, and therefore they also have not been suitable for the handling of longer 40 foot containers.

As known in the art, empty containers are stored in ports such that several containers are placed one upon the other. Containers are handled by means of transfer and transport devices, for example, straddle carriers, the gripping member of which grips the container from above one container at a time, so that the container can be transferred to a desired location.

OBJECTS OF THE INVENTION

An object of the invention is to create a device and a method for handling of containers in order to handle several containers simultaneously by a container transfer device.

One object of the invention is to provide a device for use in connection with a container transfer device, for example, a straddle carrier, and a method in which the auxiliary device is used.

BRIEF SUMMARY OF THE INVENTION

With a view to achieving the objects described above as well as those coming out later, the device according to the invention is mainly characterized in what is stated in the characterizing part of claim 1.

The method according to the invention is in turn mainly characterized in what is stated in the characterizing part of claim 10.

The invention can be applied in connection with the handling of containers that comply in respect of their height with the standards in force such that the location of the corner fittings is known. One exemplifying embodiment of the invention is suitable for handling containers that comply with the standard in respect of their length, but another exemplifying embodiment of the invention is suitable for use also in connection with containers the length of which does not comply with the standard.

One requirement of the method and the device in accordance with the invention is that the containers placed one upon the other and handled at the same time by the device and in the method shall be of equal length. Height does not impose any limitations.

The device used in connection with the invention is a lifting device which is attached to a length-adjustable gripping member of a container transfer device, for example, a straddle carrier and which enables two or more containers to be lifted and transported.

In accordance with the invention, the device comprises members which are attached to the apertures of the container corner fittings and which attachment members have been placed on the end pieces of the device which have been connected to each other by means of longitudinal frame structures. The frame structure of the device can be fixed or telescopic, so that its length can be adjusted.

In accordance with the invention, the device comprises attachment members placed on the end pieces of the device such that those attachment members which are not needed in lifting containers of a certain height, i.e which are not in use, have been placed such that they retract inside, for example, by applying spring loading, by means of a gas pump or an electric device, so that they will not impede the gripping of the attachment members in use.

In accordance with the invention, the end pieces have been connected to each other such that each end piece engages the corner fittings of the lowermost container(s) and, even though the containers stacked on each other would be misaligned, the attachment members find their way to their positions in the corner fitting apertures. Because of this advantageous additional feature, the arrangement in accordance with the invention takes into account the usual small inaccuracy in stacking because, in practice, containers are never exactly one upon the other. The device in accordance with the invention centers itself such that it grips both or a plurality of stacked containers. The centering can be carried out by means of an actuator, springs, pumps and equivalent.

In accordance with an advantageous feature of the invention, the driver of the container transfer device, for example, a straddle carrier, is supplied with information about pins positioned in place, for example, by means of flaps, signal lights or equivalent signaling means known in themselves.

The invention is particularly well suited to the handling of empty containers weighing less than 5000 kg, but full/heavier containers can also be handled by means of it. The invention is particularly well suited to the handling of containers of standard length, in particular 20 and 40 foot containers.

In accordance with one advantageous additional feature of the invention, when it is desirable to handle containers of non-standard length, it is possible to use the device of the invention that, in accordance with an advantageous additional feature, has been provided with telescopic or slide beams, whereby the length of the device can be adjusted.

BRIEF DESCRIPTION OF THE DRAWINGS

In the following, the invention will be described in greater detail with reference to the figures in the appended drawing, but the invention is not meant by any means to be narrowly limited to the details of them.

DETAILED DESCRIPTION OF THE INVENTION

Figure 1A:
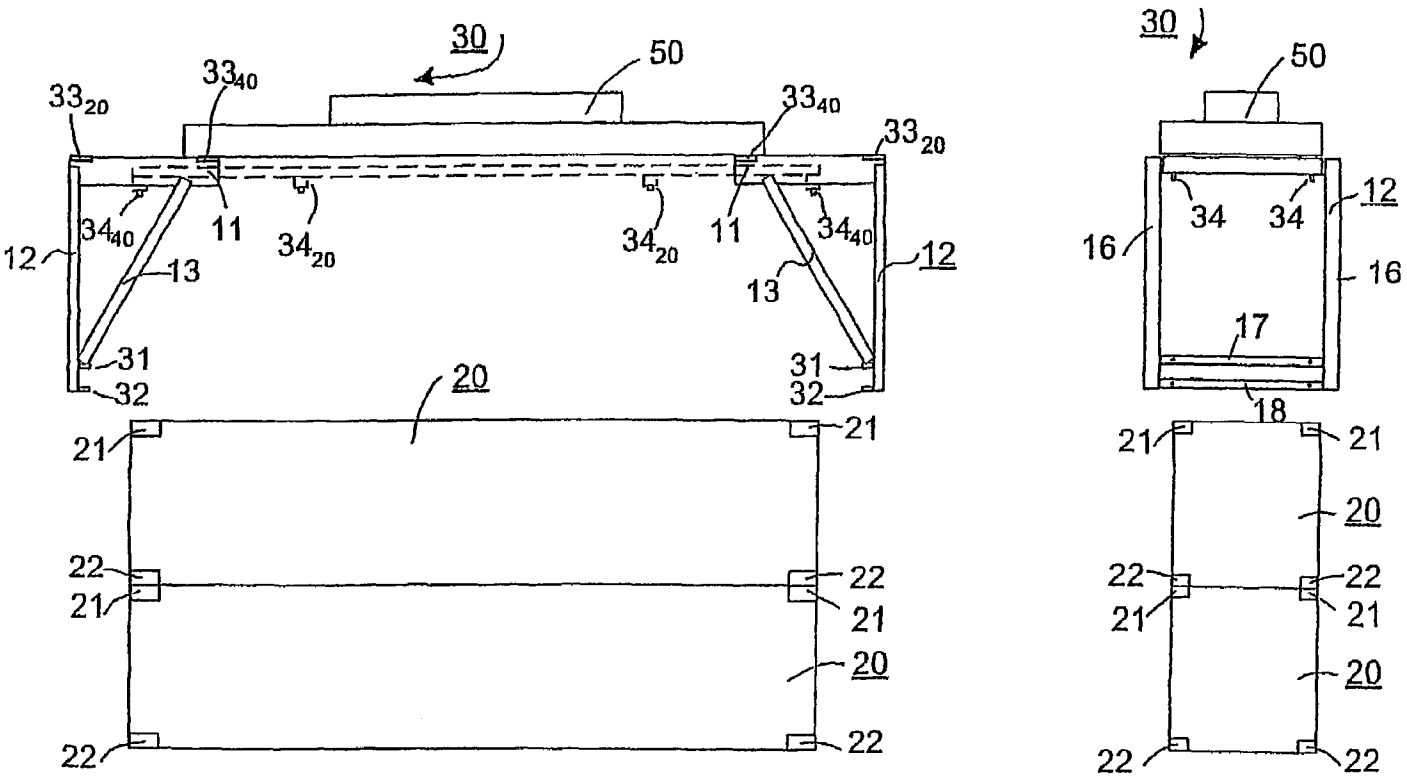
FIGS. 1A–1C schematically show the different stages of the operation of the device in accordance with the invention.

As shown in FIGS. 1A–4, the device in accordance with the invention comprises a frame 10 and end frameworks 12 moving on guides 11 of the frame 10. The end frameworks 12 are provided with attachment members 31, 32, for example, pins. The frame 10 is horizontal and the end pieces, i.e. the end frameworks 12, are substantially vertical. When needed, the end framework is provided with a diagonal support 13 to support the structure. The attachment members 31 and 32 are placed on vertical frame structures 15 and 16 of the end framework 12. In FIGS. 1–4, the container is designated by the reference numeral 20, top corner fittings of the container 20 are designated by the reference numeral 21 and its bottom corner fittings are designated by the reference numeral 22. The top corner fittings 21 have apertures in the upper surface and in the end surface. The bottom corner fittings 22 have apertures in the lower surface and in the end surface. In addition, the corner fittings 21, 22 of the containers 20 usually also have apertures in the side surfaces. Two containers 20 placed one upon the other are handled in the schematic illustration of the different stages of the operation of the device in accordance with the invention shown in FIGS. 1A–1C.

FIG. 1A shows guide pins 34 for both a 40 foot container, $\mathbf{34}_{40}$, and a 20 foot container, $\mathbf{34}_{20}$. The guide pins $\mathbf{34}_{20}$ for the 20 foot container have been omitted from the other figures for the sake of clarity. The guide pins $\mathbf{34}_{20}$ for the 20 foot container are, for example, movable, so that they do not impede the handling of the 40 foot container. FIG. 1A also shows a gripping member 50 of a container transfer device for engaging attachment points $\mathbf{33}_{20}$, $\mathbf{33}_{40}$ of the device 30, in accordance with the invention depending on the length of the container to be handled. The gripping member 50 has been omitted from the other figures for the sake of clarity. In the following description, only the reference numeral 34 is used of the guide pins for the sake of clarity.

In the situation shown in FIG. 1A, the containers 20 are in a stack on top of each other and the device in accordance with the invention has been moved above the containers 20. In this situation, in accordance with the invention, the gripping member 50 of the container transfer device (not shown), for example, a straddle carrier, has engaged by means of its twist lock pins the attachment points $\mathbf{33}_{20}$ or $\mathbf{33}_{40}$ of the device 30 in accordance with the invention. When 20 foot long containers 20 are handled, the attachment points $\mathbf{33}_{20}$ are engaged, and when 40 foot containers are handled, the attachment points $\mathbf{33}_{40}$ are engaged.

Figure 1B:
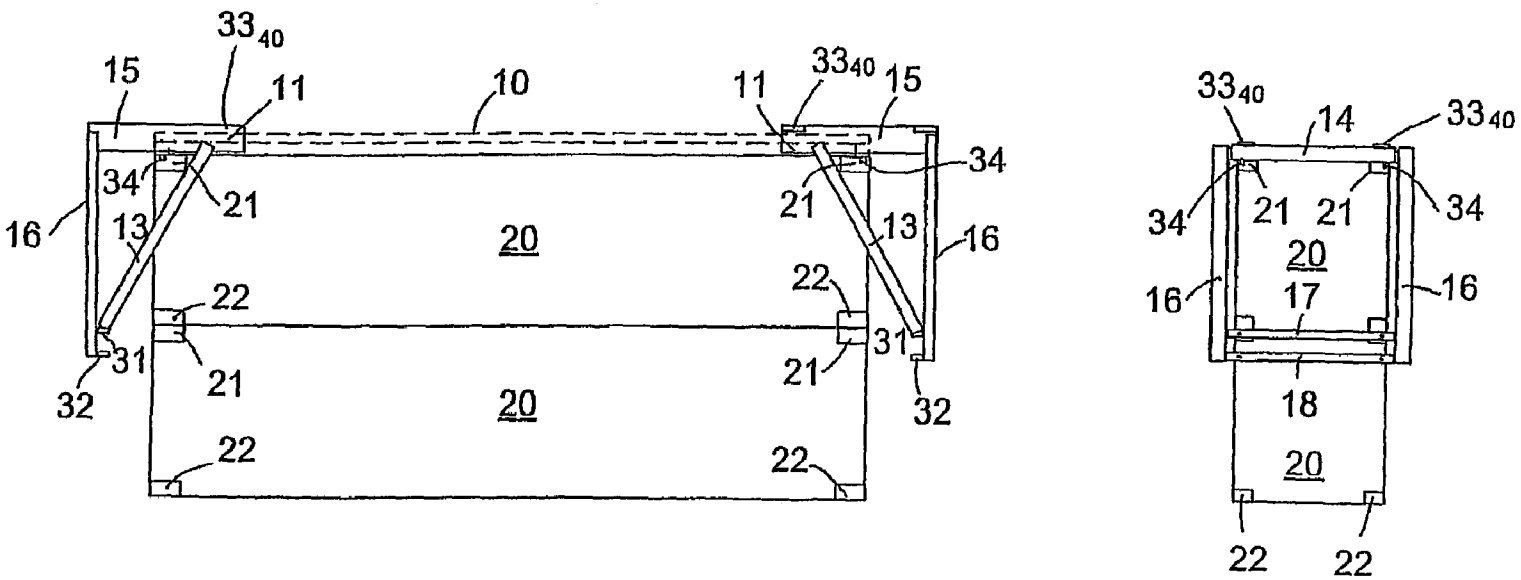
Figure 1C:
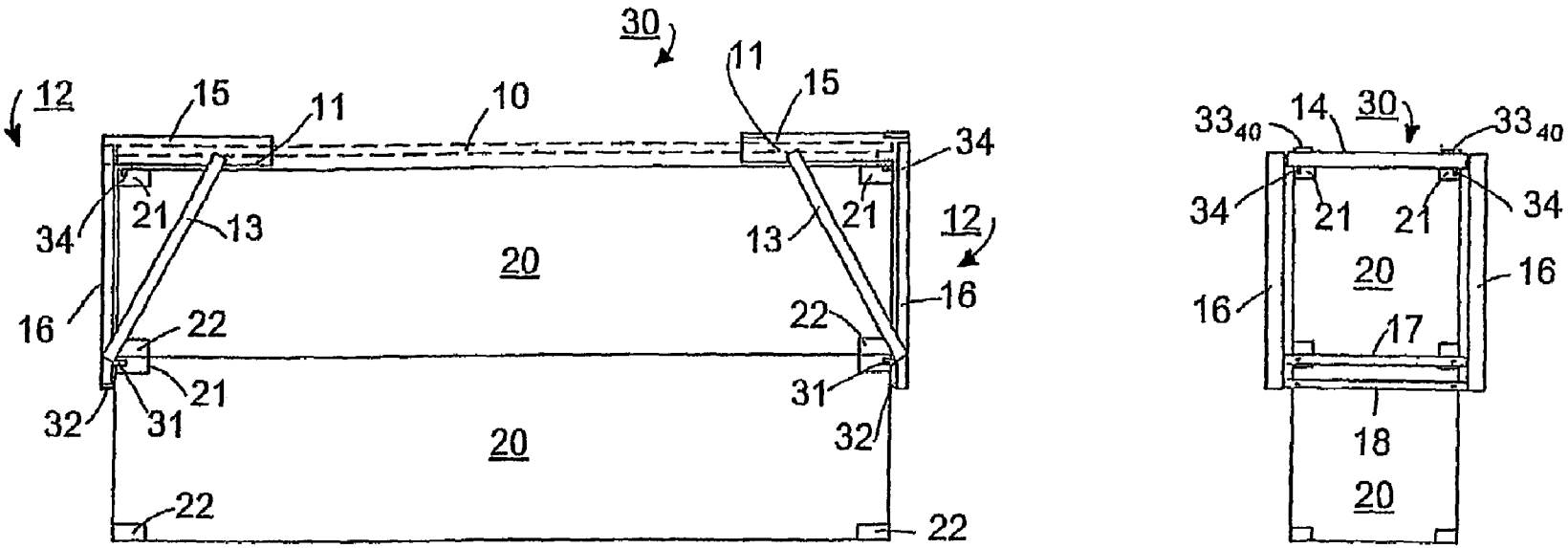

As shown in FIG. 1A, the lifting device 30 is moved above the containers 20 to be transferred and the guide pins 34 provided on the frame 10 are lowered into the apertures in the upper surface of the top corner fittings 21 of the upper container 20 (FIG. 1B). The guide pins provided 34 on the frame 10 are lowered into the upper apertures of the top corner fittings 21 of the upper container 20, whereby the device is positioned in a correct position with respect to the containers 20. The length of the gripping member of the straddle carrier is adjusted so as to be of correct length and the end frameworks 12 are pressed against the end walls of the containers 20 (FIG. 1C). The attachment members, for example, spindle pins, situated on the end frameworks 12 are inserted in through the end apertures of the top corner fittings 21 of the lower container 20, after which the lifting device 30 can be lifted upwards and both containers 20 can be transported simultaneously. In the exemplifying embodiment shown in FIGS. 1A–1C, two 40 foot long containers placed one on top the other are handled, and the containers 20 are 8½ feet high, so that the lower attachment members 32 of the end frameworks 12 retract inside, while the upper attachment members 31 are positioned in the apertures in the end walls of the top corner fittings of the lower container 20, as shown in FIG. 1C. Detachment of the containers 20 takes place after they have been lowered to the ground such that the length of the gripping members of the straddle carrier is adjusted to be longer and the lifting device 30 is lifted away from top of the containers 20. The lifting device 30 attached to the container transfer device is moved onto containers 20 which are to be transferred/lifted.

Figure 5:
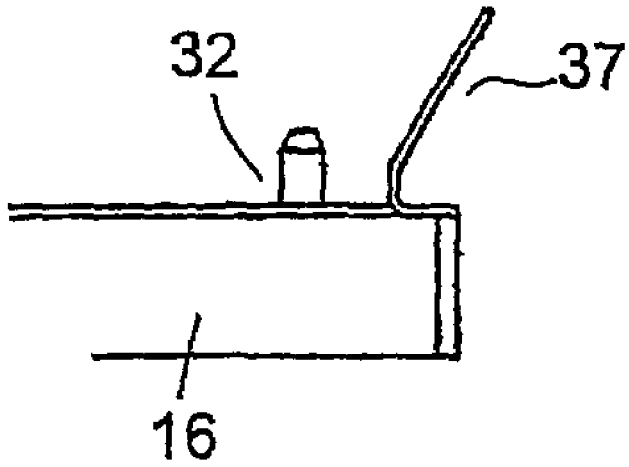
FIG. 5 is a schematic partial enlargement of one vertical frame structure 16 of an end framework, and of an attachment member 32 placed on said frame structure, and of a mechanism 37 associated with said frame structure.

The length of the gripping member of the container transfer device is shortened from 35 feet to 30 feet, so that the spindle pins 31 on the end pieces 12 are inserted in through the end apertures of the top corner fittings 21 of the lower container 20. If the lower container 20 is not quite exactly aligned with the upper container 20, a spindle beam 17 moves in a lateral direction and guide members 37 (FIG. 5) leaning against the side surfaces of the corner fittings 21 align the spindle pins 31 with the apertures.

In FIGS. 1A–1C, the upper container 20 is 8½ feet high, so the lower spindle pin 32 is pressed against the corner post of the lower container 20, yielding as spring-loaded. Similarly, if the upper container 20 is 9½ feet high, the upper "unnecessary" spindle pin yields in a corresponding manner.

If the containers to be lifted are 20 feet long, the pins on the frame at the 20 foot container 20 are lowered into the apertures of the top corner fittings 21. After that, the operation is continued as described above.

As shown in the figures, in accordance with the invention, in the lower part of the end frameworks 12 there are attachment members 31, 32, for example, spindle pins at two different levels, thus enabling the handling of both 8½ foot and 9½ foot high containers 20. These attachment members 31, 32 include guides 34 and a mechanism 37 which enables handling of the container 20 although they would not be quite exactly on top of each other.

Figure 2:
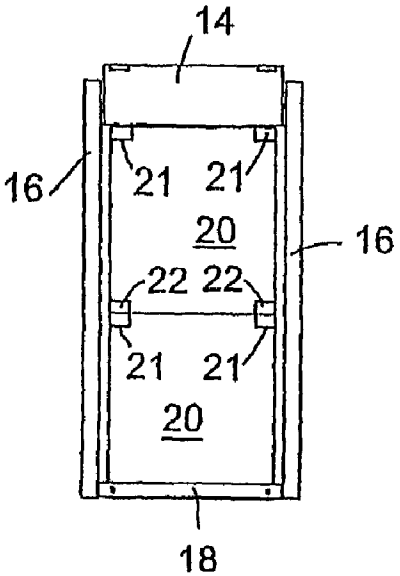
FIG. 2 shows a modification of the invention when lifting four 20 foot containers at a time.
Figure 2:
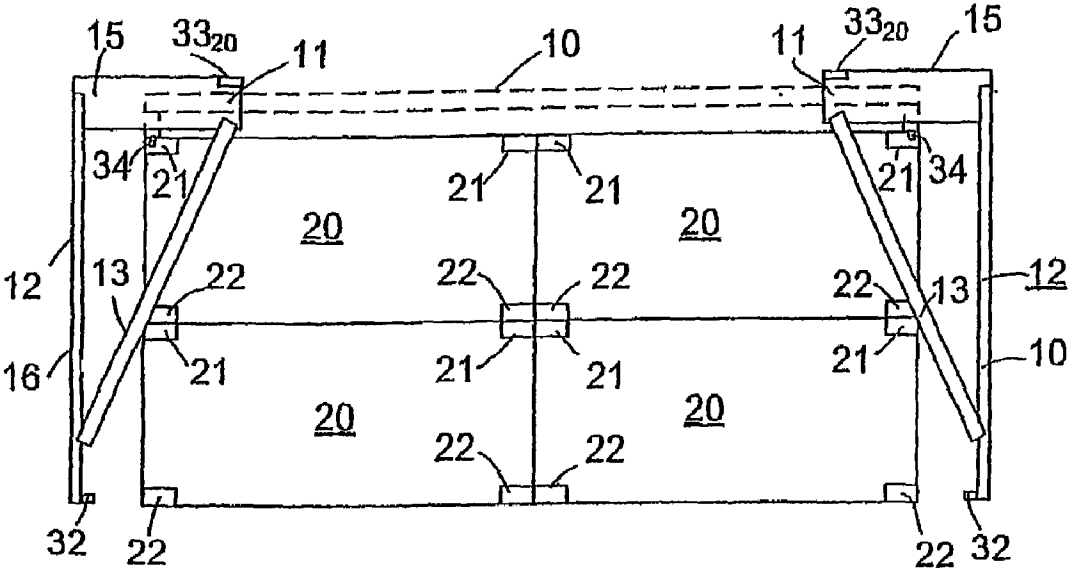

As shown in the application of FIG. 2, in accordance with the invention it is possible to lift and move, for example, four 20 foot long containers 20 at the same time if the lifting height of the lifting machine, for example, a straddle carrier, is sufficiently great. In that case, the end piece 12 engages the bottom corner fittings 22 of the lower containers 20.

Figure 4:
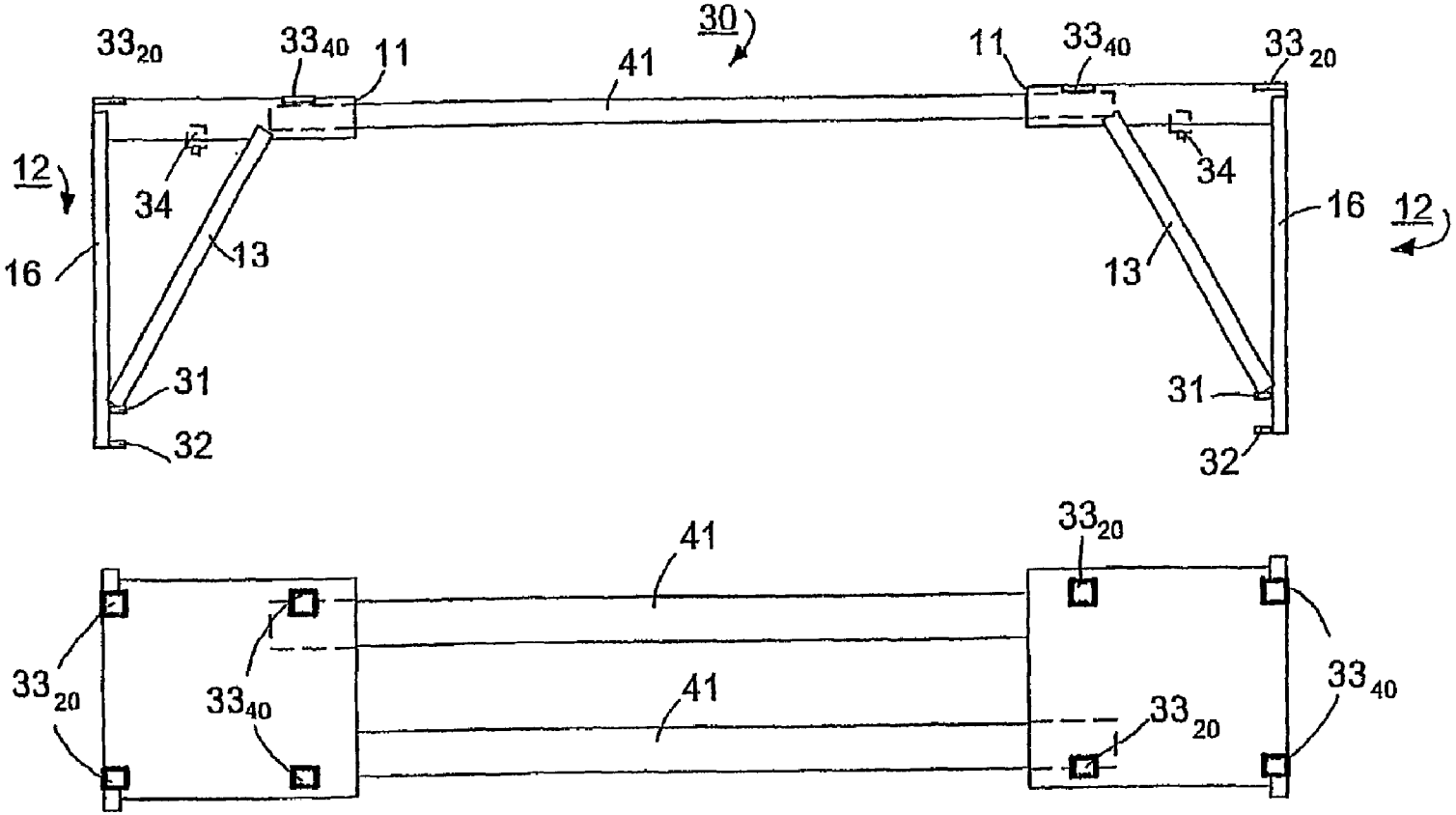
FIG. 4 is a schematic view of an application of the invention as provided with telescopic or slide beams.

The frame 10 of the device 30 in accordance with the invention is provided with guides and it is a framework that is, for example, about 12 m long and 2.5 m wide, and it incorporates the guide pins 34 needed for the alignment of the invention, as well as the end pieces 12 moving on its guides 11. As shown in FIG. 4, the frame 10 can be alternatively replaced with a telescopic profile, in which case the alignment spindles 34 are situated on the end pieces 12. The end piece 12 is composed of horizontal beams 15 moving on the guides 11 of the frame 10, support beams 13 between them, attachment points $\mathbf{33}_{20}$, $\mathbf{33}_{40}$ for the twist lock pins of the container transfer device, vertical beams 16 and spindle beams 17, 18 on which the spindle pins 31, 32 are located.

Figure 3:
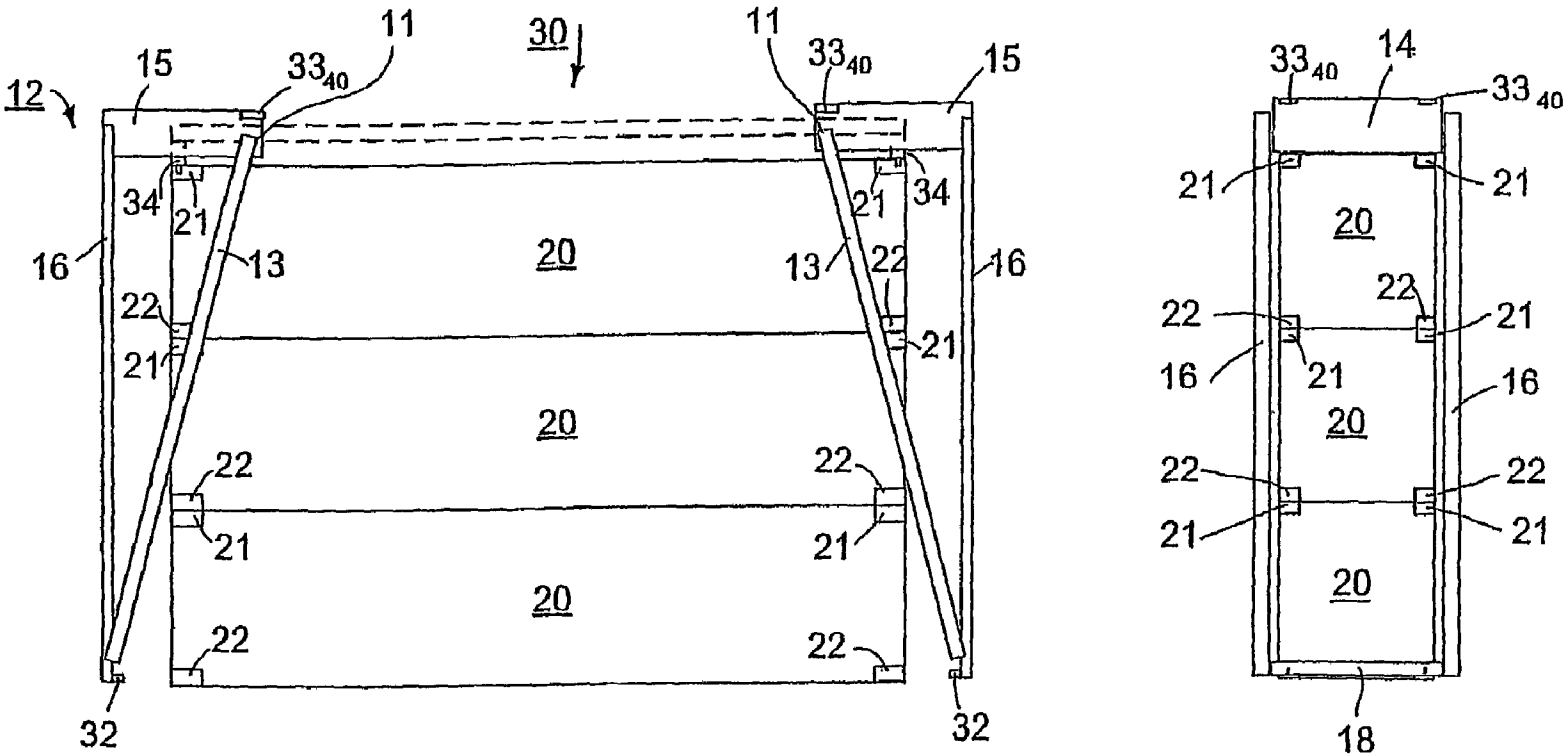
FIG. 3 is a schematic view of an application of the invention when lifting three containers one upon the other.

As shown in FIG. 3, the invention is also suitable for use when lifting three containers 20 placed on top of one another. In that case, the end pieces 12 are placed such that the attachment members, i.e. the spindle pins 32, of the end pieces 12 are placed in the bottom corner fittings 22 of the lowermost container 20.

Above, the invention has been described with reference to some of its advantageous exemplifying embodiments only, but the invention is not meant by any means to be narrowly limited to the details of them.

The invention claimed is:

1. A device in the handling of containers, by means of which device (30) at least two containers (20) that are placed on top of one another are handled, which device (30) comprises a frame (10) having guides (11) to which end pieces (12) are movably attached, wherein said end pieces (12) comprise attachment members (31, 32) for attaching the device (30) to corner fittings of the lowermost container(s) (20) of said at least two containers (20) placed on top of one another, wherein guide pins (34) used for aligning the device (30) have been fixed to the end pieces (12) moving on the guides of the frame (10), wherein said guide pins have been arranged to be placed into apertures in the upper surface of the top corner fittings of the uppermost container(s) of the containers (20) which have been placed on top of one another, and that the device (30) is a lifting device attached to a length-adjustable gripping member of a container transfer device by twist lock pins of said adjustable gripping member.

2. A device as claimed in claim 1, wherein said attachment members (31, 32) are attached to the apertures of the corner fittings of the lowermost container(s) (20) and which attachment members (31, 32) are placed on the end pieces of the device (30) which have been connected to each other with longitudinal portions at said frame (10, 11).

3. A device as claimed in claim 1 wherein the frame (10) of the device (30) is a framework provided with guides (11).

4. A device as claimed, in claim 1, wherein the end pieces (12) of the device (30) comprise horizontal beams (15) movable on the guides (11) of the frame (10), support beams (13) and attachment points ($\mathbf{33}_{20}$, $\mathbf{33}_{40}$) for twist lock pins of a container transfer device, and verticle beams (16) and beams (17, 18) to which the attachment members (31, 32) have been fixed.

5. A device as claimed, in claim 1, wherein the attachment members (31, 32) are flexible such that the attachment members which are not in use are retracted so that they reside within said end pieces.

6. A device as claimed in claim 1, wherein the guides (11) of the frame (10) are telescopic frames, so that the length of the frame can be adjusted.

7. A device as claimed in claim 1, wherein the frame (10) of the device is fixed.

8. A device as claimed in claim 1, wherein said guide pins (34) which have been arranged to be positioned in the apertures of the upper surface of the top corner fittings of the uppermost container, and a guide member (37) disposed in connection with the end piece to center the device in place.

9. A method in the handling of containers, in which method at least two containers (20) that are placed on top of one another and are fitted with a container transfer device, are handled by a lifting device (30): wherein said container transfer device comprises a length adjustable gripping member; and wherein said lifting device is placed on the containers (20) and attached to corner fittings (21, 22) of the containers (20) such that attachment members (31, 32) situated on end pieces (12) fixed to guides (11) of the frame (10) of the lifting device (30) are arranged to be attached to apertures in the corner fittings (21, 22) of the container (20), wherein in the method, the lifting device (30) is in place by means of guide pins (34) placed on the end pieces (12) moving on the guides (11) of the frame (10), which guide pins (34) are placed in the apertures of the upper surface of the top corner fittings (21) of the uppermost container (20), and that the lifting device (30) used in the method is attached to said length adjustable gripping member of the container tranfer device by twist lock pins of said length adjustable member.

10. A method as claimed in claim 9, wherein in the method, the lifting device is further aligned in place by means of guide members (37) fixed to the end pieces (12).

* * * * *